US012595951B2

(12) United States Patent
Kang

(10) Patent No.: US 12,595,951 B2
(45) Date of Patent: Apr. 7, 2026

(54) REFRIGERATOR

(71) Applicant: LG Electronics Inc., Seoul (KR)

(72) Inventor: Daekil Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 41 days.

(21) Appl. No.: 18/400,293

(22) Filed: Dec. 29, 2023

(65) Prior Publication Data

US 2024/0219097 A1 Jul. 4, 2024

(30) Foreign Application Priority Data

Dec. 30, 2022 (KR) ..... 10-2022-0191056
Dec. 28, 2023 (KR) ..... 10-2023-0194352

(51) Int. Cl.
*F25D 17/04* (2006.01)
*F25D 23/06* (2006.01)
*F25D 27/00* (2006.01)

(52) U.S. Cl.
CPC ..... *F25D 17/045* (2013.01); *F25D 23/068* (2013.01); *F25D 27/00* (2013.01); *F25D 2317/0415* (2013.01); *F25D 2317/0672* (2013.01); *F25D 2323/0024* (2013.01); *F25D 2323/00278* (2013.01); *F25D 2323/021* (2013.01)

(58) Field of Classification Search
CPC ..... F25D 2317/0415; F25D 27/00; F25D 17/042; F25D 2317/0665; F25D 23/068
See application file for complete search history.

(56) References Cited

U.S. PATENT DOCUMENTS 5,468,447 A * 11/1995 Bermas ..... A61L 9/12 422/4
2003/0024254 A1* 2/2003 Yoshida ..... F25D 17/065 62/78
2010/0199706 A1 8/2010 Bischofberger et al.
2020/0386466 A1* 12/2020 Jeong ..... F25D 27/00

FOREIGN PATENT DOCUMENTS

EP 2487438 B1 11/2018
JP 2002-147936 A 5/2002
JP 2007-170781 A 7/2007
JP 4285245 B2 6/2009
WO WO-2022149698 A1 * 7/2022 ..... A61L 9/205
WO WO-2023059300 A1 * 4/2023 ..... A23B 2/805

OTHER PUBLICATIONS

WO-2022149698-A1 Translation (Year: 2022).*
WO-2023059300-A1 Translation (Year: 2023).*
Extended European Search Report in European Appln. No. 23220601.1, mailed on May 8, 2024, 7 pages.

* cited by examiner

*Primary Examiner* — David J Teitelbaum
(74) *Attorney, Agent, or Firm* — Fish & Richardson P.C.

(57) ABSTRACT

A refrigerator includes: a cabinet which has a storage space with an open front surface; a door which is provided in the cabinet and opens and closes the storage space; an evaporator which is provided in the cabinet; an upper duct which extends above the storage space in a front and rear direction and guides cold air from the evaporator; and a deodorizing device which is provided on the upper surface of the storage space, in which an upper discharge port is formed in the upper duct to discharge cold air at the front end of the upper surface of the storage space, and the deodorizing device is disposed adjacent to the upper discharge port to deodorize cold air discharged through the upper discharge port.

18 Claims, 5 Drawing Sheets

REFRIGERATOR

CROSS-REFERENCE TO RELATED APPLICATIONS

The present application claims priority under 35 U.S.C. 119 of Korean Patent Application No. 10-2022-0191056, filed on Dec. 30, 2022, and Korean Patent Application No. 10-2023-0194352, filed on Dec. 28, 2023, in the Republic of Korea, which are hereby incorporated by reference in their entirety.

BACKGROUND

The present disclosure relates to a refrigerator.

In general, a refrigerator is a home appliance that allows food to be stored at low temperatures in an internal storage space shielded by a refrigerator door, and the refrigerator is designed to keep stored food in optimal condition by cooling the inside of the storage space using cold air generated through heat exchange with the refrigerant circulating in the refrigeration cycle.

The refrigerator is gradually becoming larger and more multi-functional in accordance with changes in eating habits and the trend toward higher quality products, and a refrigerator equipped with various structures and convenience devices that take user convenience into consideration are being released.

In particular, there is a refrigerator equipped with a deodorizing device to improve hygiene inside the refrigerator and to resolve user complaints due to odor.

In general, the deodorizing device has a structure that is disposed in a cold air flow path to remove odors in the air circulating inside the refrigerator.

This deodorizing device has a structure that is placed on the rear wall of the inside of the refrigerator, so it is directly exposed when the door is opened, causing a problem in the outer appearance thereof. Additionally, because the deodorizing device has a structure that protrudes forward, there is a loss of storage space.

In particular, when the deodorizing device is placed above the rear of the space inside the refrigerator, not only does the storage space visually appear narrow, but there is a problem that deodorization efficiency is reduced because the air for deodorizing air is circulated at the rear of the inside of the refrigerator.

SUMMARY

An object of an embodiment of the present disclosure is to provide a refrigerator having a disposition structure of a deodorizing device that improves deodorizing efficiency inside the refrigerator.

An object of an embodiment of the present disclosure is to provide a refrigerator having a disposition structure of a deodorizing device that improves the outer appearance of the storage space.

An object of an embodiment of the present disclosure is to provide a refrigerator that improves the flow of cold air in the space inside the refrigerator and at the same time allows the flow of sterilized and deodorized air.

A refrigerator according to an embodiment of the present disclosure includes a cabinet which has a storage space with an open front surface; a door which is provided in the cabinet and opens and closes the storage space; an evaporator which is provided in the cabinet; an upper duct which extends above the storage space in a front and rear direction and guides cold air from the evaporator; and a deodorizing device which is provided on the upper surface of the storage space, in which an upper discharge port may be formed in the upper duct to discharge cold air at the front end of the upper surface of the storage space, and the deodorizing device may be disposed adjacent to the upper discharge port to deodorize cold air discharged through the upper discharge port.

The cabinet may include an outer case which forms an outer appearance of the cabinet; an inner case which is spaced apart from the outer case to form the storage space; and an insulating material which is filled between the outer case and the inner case, and the upper duct may be disposed to be surrounded by the insulating material between the outer case and the inner case.

An additional insulating material having a higher insulation coefficient than the insulating material may be disposed between the upper duct and the upper surface of the storage space.

A first inclined surface may be formed at the front end of the upper surface of the storage space, which is disposed to face the circumference of the door when the door is closed and protrudes further downward as it extends rearward.

The deodorizing device may be positioned rearward of the first inclined surface, and at least a portion of the deodorizing device may be disposed higher than the lower end of the first inclined surface.

A lighting device may be provided on the upper surface of the storage space, and the lighting device may be disposed between the first inclined surface and the deodorizing device.

The lighting device may include an LED; and a light cover which shields the LED and is exposed to the storage space, and transmits light emitted from the LED, and the light cover may form a second inclined surface inclined in a direction crossing the first inclined surface.

The deodorizing device may include a deodorizing cover formed with a deodorizing device discharge port through which deodorized air is discharged, the outer surface of the deodorizing cover may include a third inclined surface that becomes lower toward the rear, and the third inclined surface may extend in a direction crossing the second inclined surface and thus the light from the lighting device may be irradiated to the third inclined surface.

The deodorizing device may include a deodorizing filter through which cold air passes through the upper duct; a deodorizing filter mounting part on which the deodorizing filter is mounted; and a deodorizing cover which shields the deodorizing filter and forms an exposed outer surface of the deodorizing device, and a deodorizing device discharge port through which air deodorized through the deodorizing filter is discharged may be formed in the deodorizing cover.

The deodorizing device may further include a sterilization LED which irradiates light for sterilization toward the deodorization filter.

The deodorizing filter mounting part may be provided in the upper duct, and the deodorizing filter may be disposed in the upper duct.

The deodorizing filter mounting part may be provided on the deodorizing cover, and the deodorizing filter may be disposed within the upper duct.

The upper discharge port may be disposed on both left and right sides based on the deodorizing cover.

The deodorizing cover may include a first surface inclined so as to be farther away from the lower surface of the deodorizing filter as it extends rearward; and a second surface inclined in a direction crossing the first surface at the rear end of the first surface, and the deodorizing device discharge port may be formed on the second surface.

The first surface may extend further rearward than the rear end of the deodorizing filter.

The deodorizing device may further include a deodorizing fan which forces air flow to pass through the deodorizing filter, a recessed part in which at least a portion of the deodorizing device may be accommodated and which is shielded by the deodorizing cover is formed in the upper surface of the storage space, and the deodorizing device may be disposed behind the upper discharge port.

The deodorizing cover may include a circumferential surface which protrudes further downward than the recessed part, and a deodorizing device suction port through which cold air discharged from the upper discharge port is suctioned and the deodorizing device discharge port may be formed on the circumferential surface.

The deodorizing device suction port may be disposed higher than the deodorizing device discharge port.

A rear duct may be formed at the rear surface of the storage space, which extends vertically, guides cold air from the evaporator upward, and has a discharge port which discharges cold air forward, and the upper end of the rear duct may be connected to the rear end of the upper duct.

A suction port into which cold air flows may be formed at the lower end of the rear surface of the storage space, and a deodorizing device discharge port formed in the deodorizing device may be disposed to face the suction port diagonally.

The following effects can be expected from the refrigerator according to the proposed embodiment.

According to an embodiment of the present disclosure, a deodorizing device is provided in the first half of the upper surface of the storage space adjacent to the user when the user opens the door, thereby providing cleaner air to the user, thereby there is an advantage of satisfying the user's emotions.

In addition, a deodorizing device is provided at the end portion of the flow path that discharges cold air to cool the door storage space, and deodorized and sterilized air can be provided at a location very close to the final point reaching the user, thereby there is an advantage of increasing user satisfaction.

According to an embodiment of the present disclosure, the deodorized air is discharged downward from the upper half of the storage space, and the heat-exchanged air within the storage space is suctioned into the evaporator from the lower end of the rear surface of the storage space, thereby there is an advantage in that the efficiency of cold air circulation and deodorization performance can be expected to be improved by ensuring effective overall air circulation and deodorization.

According to an embodiment of the present disclosure, the deodorizing device is disposed at the front end portion of the upper surface inside the refrigerator, but the flow path to the discharge port of the deodorizing device is positioned in an insulated space to deodorize air maintained at a low temperature. It is possible to perform deodorization and sterilization work in a state where air is relatively not diffused, and thus it is possible to provide improved deodorization performance.

In addition, odor factors in the air passing through the evaporator are removed by primary removal as they pass through the evaporator, and are secondarily removed by the deodorizing device while maintaining low temperature as they pass through ducts connected through the rear and upper surfaces of the storage space, and thus there is an advantage that deodorization performance can be further improved.

According to an embodiment of the present disclosure, the deodorizing device is positioned in the front half of the upper surface inside the refrigerator, preventing direct exposure to the front of the user when the door is opened, thereby improving the outer appearance of the inside of the storage space.

In particular, the deodorizing device protrudes from the upper surface of the storage space, but the front end of the storage space or the lighting device may protrude further in front of the deodorizing device and cover the deodorizing device. Therefore, there is an advantage in that the outer appearance of the inside of the storage space can be improved by minimizing exposure of the deodorizing device.

In addition, by placing the deodorizing device on the upper surface and the front half inside the refrigerator, more space in the middle or rear of the storage space where food is mainly stored can be secured, and the efficiency of utilizing the storage space can be improved.

DETAILED DESCRIPTION OF THE EMBODIMENTS

Hereinafter, specific embodiments of the present disclosure will be described in detail along with the drawings. However, the present disclosure cannot be said to be limited to the embodiments in which the idea of the present disclosure is presented, and other disclosures that are regressive or other embodiments included within the scope of the present disclosure can be easily suggested by adding, changing, or deleting other components.

Hereinafter, embodiments of the present disclosure will be described in detail through exemplary drawings. In describing embodiments of the present disclosure, detailed descriptions of related known components or functions will be omitted if they are judged to be obvious to those skilled in the art.

In addition, it should be noted in advance that, for convenience of explanation and understanding, the following embodiments only illustrate a refrigerator in which the refrigerating chamber is provided above the freezing chamber, and the present disclosure is not limited thereto, and the present disclosure is applicable to all types of refrigerators in which ducts can be placed on the rear surface and the upper surface of the storage space.

Before explaining, the direction is defined. In an embodiment of the present invention, the direction toward the open entrance of the storage space illustrated in FIG. 1 may be referred to as a front direction, the direction toward the inside of the storage space based on the front surface of the open door may be referred to as a rear direction, and the direction toward the floor where the refrigerator is installed may be referred to as a lower direction, and the direction away from the floor may be referred to as an upper direction.

Figure 1:
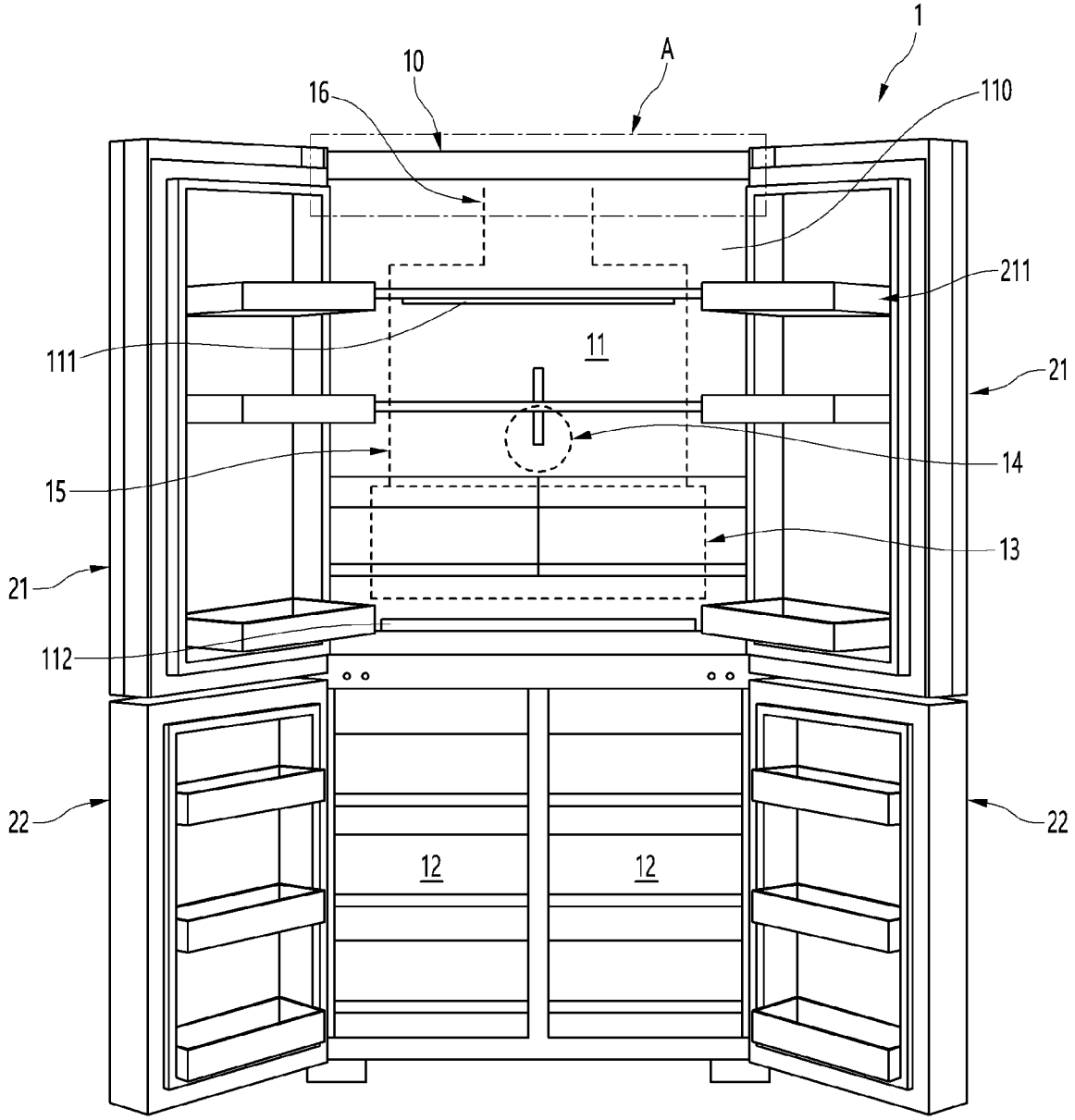
FIG. 1 is a front view illustrating a refrigerator according to a first embodiment of the present disclosure with the door open.

FIG. 1 is a front view illustrating a refrigerator according to a first embodiment of the present disclosure with the door open.

As illustrated, the refrigerator 1 according to an embodiment of the present disclosure includes a cabinet 10 in which a storage space is formed and a door 20 that opens and closes the storage space.

For example, the storage space may be divided up and down, with a refrigerating chamber 11 formed at the upper portion and a freezing chamber 12 formed at the lower portion. For example, the refrigerating chamber 11 may be referred to as a first storage space, and the freezing chamber 12 may be referred to as a second storage space.

Additionally, the door 20 may include a refrigerating chamber door 21 that opens and closes the refrigerating chamber 11 and a freezing chamber door 22 that opens and closes the freezing chamber 12. The refrigerating chamber door 21 may be referred to as a first door, and the freezing chamber door 22 may be referred to as a second door. For example, the refrigerating chamber door 21 may be rotatably mounted on the cabinet 10 to open and close the refrigerating chamber 11. In addition, a pair of refrigerating chamber doors 21 are provided on both left and right sides, so that the pair of refrigerating chamber doors can partially open and close the refrigerating chamber, respectively. Additionally, the freezing chamber door 22 may be rotatably mounted on the cabinet 10 to open and close the freezing chamber 12. In addition, a pair of freezing chamber doors 22 are provided on both left and right sides, so that the pair of freezing chamber doors can partially open and close the freezing chamber, respectively.

Of course, the present disclosure is not limited to the storage space and door shape and may be applied to various types of refrigerators.

The refrigerating chamber 11 and the freezing chamber 12 can be cooled by cold air supplied from the evaporator 13. As an example, the evaporator 13 may include a refrigerating chamber evaporator provided in the refrigerating chamber 11 and a freezing chamber evaporator provided in the freezing chamber 12. As another example, the evaporator 13 may be provided only in the freezing chamber 12, and the cold air from the evaporator 13 may be supplied to both the refrigerating chamber 11 and the freezing chamber 12.

The storage space may be provided with a cold air duct that guides the cold air generated from the evaporator 13 into the storage space. As an example, the cold air duct may include a first duct 15 and a second duct 16.

The rear wall of the refrigerating chamber 11 may be provided with a first duct 15 that moves cold air generated in the refrigerating chamber evaporator 13 upward. The first duct 15 may be referred to as a rear duct or a refrigerating chamber duct. The first duct 15 may be covered by the rear wall of the refrigerating chamber 11, and an insulating material may be disposed on at least a portion of the front of the first duct 15. In other words, at least a portion of the first duct 15 may be insulated.

The inside of the first duct 15 may be divided into multiple flow paths and may be referred to as a multi-duct. In addition, the first duct 15 may include a duct cover 110 that forms the rear surface of the refrigerating chamber 11. A plurality of rear discharge ports 111 may be formed in the first duct 15. The rear discharge port 111 may pass through the duct cover 110, open toward the refrigerating chamber 11, and discharge cold air flowing through the first duct 15 forward. The rear discharge port 111 may be referred to as a first discharge port.

A blowing fan 14 is provided at the rear of the first duct 15 to force air flow inside the first duct 15. The blowing fan 14 may be provided on one side communicating with the first duct 15. The blowing fan 14 may be provided on one side of the refrigerating chamber evaporator 13. Additionally, cold air can be circulated between the refrigerating chamber evaporator 13 and the refrigerating chamber 11 by driving the blowing fan 14.

The first duct 15 may extend to the upper end of the rear surface of the refrigerating chamber 11 and communicate with the second duct 16. The second duct 16 may be referred to as an upper duct or a door cooling duct.

The second duct 16 may be provided on the upper surface of the refrigerating chamber 11. The second duct 16 may extend forward from the rear end of the upper surface of the refrigerating chamber 11. The front end of the second duct 16 may extend to a position adjacent to the front end of the refrigerating chamber 11. Additionally, an upper discharge port 122 that discharges cold air may be formed in the second duct 16. The upper discharge port 122 may be referred to as a second discharge port. The upper discharge port 122 may be exposed to the upper surface 120 of the refrigerating chamber 11. The upper discharge port 122 may be positioned above the door storage space 211 provided at the rear surface of the refrigerating chamber door 21.

As an example, the door storage space 211 may have a basket structure. If necessary, the door storage space 211 may be a separate storage space provided at the rear surface of the refrigerating chamber door 21.

The door storage space 211 may protrude rearward from the rear surface of the refrigerating chamber door 21. Additionally, the door storage space 211 may be positioned below the upper discharge port 122. Accordingly, cold air discharged from the second duct 16 can be supplied to the door storage space 211.

The rear end of the second duct 16 may be connected to the upper end of the first duct 15. Therefore, cold air flowing along the first duct 15 may be guided to the second duct 16. Additionally, cold air flowing along the second duct 16 may be supplied downward from one side of the front end of the upper surface of the refrigerating chamber 11 and directed to the inside of the refrigerating chamber 11. In addition, some of the cold air discharged from the upper discharge port 122 of the second duct 16 may be directed to the door storage space 211.

The suction port 112 that suctions air from the refrigerating chamber toward the evaporator 13 may be positioned at the lower end of the rear wall of the refrigerating chamber 11. Accordingly, the suction port 112 may be disposed diagonally from the cold air discharged from the second duct 16 and the deodorizing discharge port 333 of the deodorizing device 30, which will be described below. Accordingly, overall circulation of cold air and deodorization/sterilization air may be possible within the refrigerating chamber 11.

Figure 2:
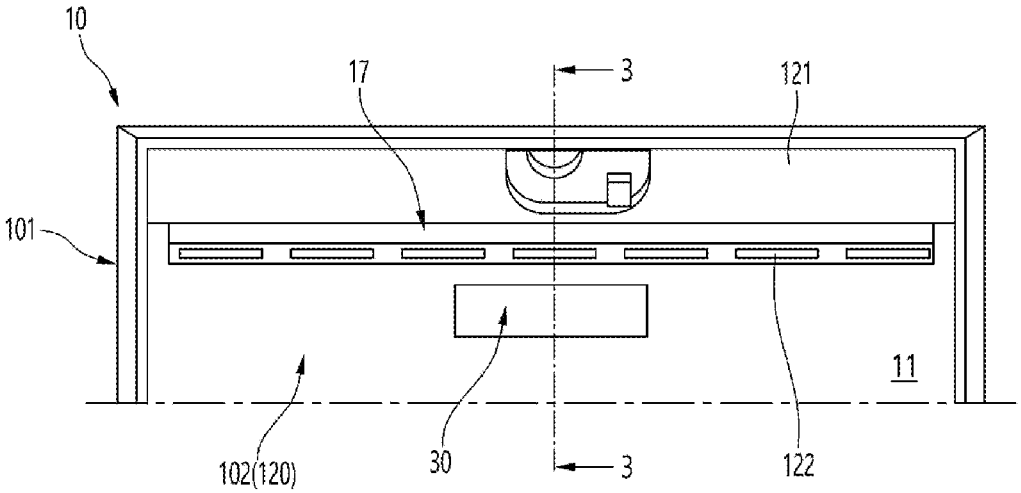
FIG. 2 is a perspective view illustrating part A of FIG. 1 viewed from below.
Figure 3:
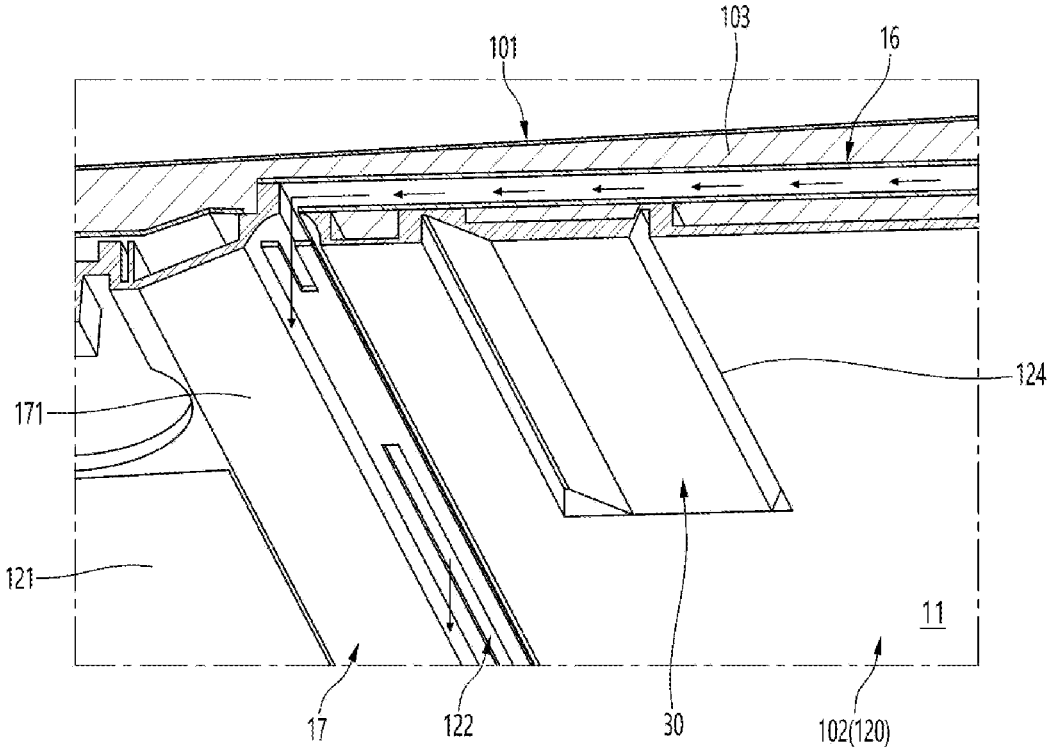
FIG. 3 is a perspective view taken along line 3-3 of FIG. 2.

FIG. 2 is a perspective view illustrating part A of FIG. 1 viewed from below, and FIG. 3 is a perspective view taken along line 3-3 of FIG. 2.

As illustrated in the drawing, the cabinet 10 may include an outer case 101 that forms the outer appearance, and an inner case 102 that is spaced apart from the outer case 101 and forms the storage space. Additionally, an insulating material 103 may be filled between the outer case 101 and the inner case 102.

A lighting device 17 may be provided on the upper surface of the refrigerating chamber 11 to illuminate the refrigerating chamber 11. Additionally, a deodorizing device 30 may be provided on the upper surface of the refrigerating chamber 11 to provide deodorized air into the refrigerating chamber 11. The deodorizing device 30 may be a device capable of deodorizing as well as sterilizing.

In addition, the second duct 16 may be provided inside the upper surface of the refrigerating chamber 11. The second duct 16 may be provided between the inner case 102 and the inner case 102 above the refrigerating chamber 11. Accordingly, the second duct 16 may be at least partially embedded in the insulating material 103.

The front end of the second duct 16 may communicate with the upper surface of the refrigerating chamber 11 to form the upper discharge port 122. The upper discharge port 122 may extend long from the upper surface of the refrigerating chamber 11 in the left and right direction. The upper discharge port 122 may be positioned somewhat rearward than the front end of the refrigerating chamber 11 and may be positioned forward of the deodorizing device 30. In addition, the upper discharge port 122 may be positioned between the lighting device 17 that illuminates the refrigerating chamber 11 and the deodorizing device 30.

A first inclined surface 121 may be formed in a portion of the inner case 102 that forms the front end of the refrigerating chamber 11. The first inclined surface 121 may become lower toward the rear, and may form a space into which a portion of the circumference of the refrigerating chamber door 21 is inserted when the refrigerating chamber door 21 is closed.

The lighting device 17 may be provided at the end portion of the first inclined surface 121. The lighting device 17 may extend long in the left and right directions, together with a plurality of LEDs, and may include a cover 172 through which light is transmitted. The cover 172 may shield the LED 171. One surface of the lighting device 17, that is, the surface of the cover 172 through which light transmits, may form a second inclined surface 173. The second inclined surface 173 may have a slope that increases toward the rear. Accordingly, the lighting device 17 is provided at the front end of the upper surface of the refrigerating chamber 11, but can illuminate the entire storage space.

The upper discharge port 122 may be provided at the rear of the lighting device 17. The upper discharge port 122 may be positioned at the same height as the rear end of the lighting device 17. Therefore, when viewed from the front by the user, direct exposure of the upper discharge port 122 can be prevented. At this time, the upper discharge port 122 may be positioned in an area vertically above the door storage space 211.

The deodorizing device 30 may be provided behind the upper discharge port 122. The deodorizing device 30 is positioned behind the upper discharge port 122, but may be positioned significantly forward with respect to the center of the upper surface of the refrigerating chamber 11. Therefore, the deodorizing device 30 can be expressed as being positioned in the first half or the front end of the upper surface of the refrigerating chamber 11.

The deodorizing device 30 may be mounted on the upper surface of the refrigerating chamber 11, and in this case, the lower end of the deodorizing device 30 may be positioned to be higher than the lower end of the first inclined surface 121 or the second inclined surface 173. Therefore, when the user views from the front, the deodorizing device 30 may not be exposed, or only a minimal portion of the deodorizing device 30 may be visible.

The deodorizing device 30 may be disposed so that at least a portion of the deodorizing device 30 is positioned higher than the upper surface of the refrigerating chamber 11. Additionally, the deodorizing device 30 may be disposed so that at least a portion of the deodorizing device 30 protrudes toward the inside of the refrigerating chamber 11.

A deodorizing discharge port 333 may be formed in the deodorizing device 30, and deodorized air may be supplied to the refrigerating chamber 11. The deodorizing discharge port 333 may be referred to as a third discharge port. At this time, the deodorizing device 30 is positioned close to the front end of the upper surface of the refrigerating chamber 11, so that when the user opens the refrigerating chamber door 21 and approaches to the refrigerating chamber, the user can be in contact with the deodorizing and sterilized air, thereby preventing the user from being exposed to odors or bacteria.

The above drawing only illustrates the location of the deodorizing device 30, and the deodorizing device 30 may have various structures and dispositions. Below, various examples of the disposition and structure of the deodorizing device 30 will be described.

Figure 4:
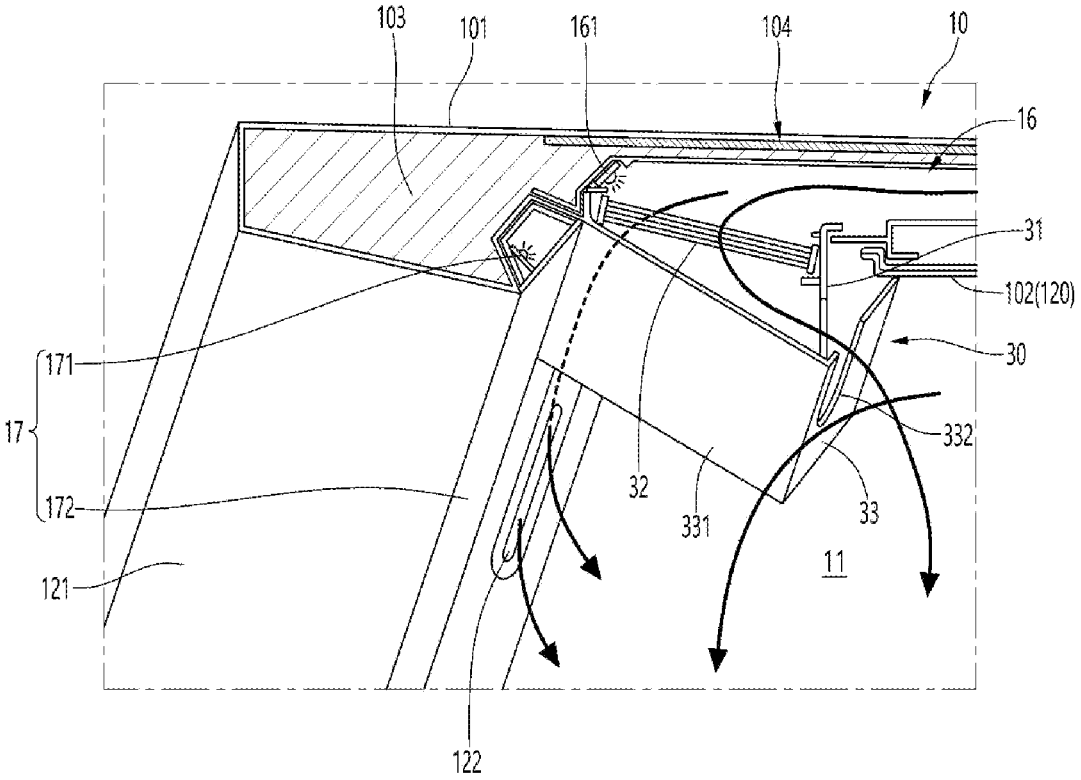
FIG. 4 is a cut-away perspective view illustrating the disposition structure and the cold air flow of the deodorizing device according to the first embodiment of the present disclosure.

FIG. 4 is a cut-away perspective view illustrating the disposition structure and the cold air flow of the deodorizing device according to the first embodiment of the present disclosure.

As illustrated, a lighting device 17 may be provided on the upper surface of the refrigerating chamber 11, and the upper discharge port 122 may be positioned at the rear end of the lighting device 17. Additionally, the second duct 16 may be disposed between the outer case 101 and the inner case 102.

Due to the disposition of the second duct 16, the insulation thickness of the upper surface of the refrigerating chamber 11 is reduced, and, to compensate for this, an additional insulating material 104 may be disposed above the second duct 16. The additional insulating material 104 may be an insulating material that has a higher insulation coefficient or has better insulation performance compared to the insulating material. As an example, the additional insulating material 104 may be a vacuum insulating material (VIP).

The deodorizing device 30 may be connected to the second duct 16 at the upper surface of the refrigerating chamber 11. Additionally, the deodorizing device 30 can deodorize and sterilize the air flowing through the second duct 16.

In detail, the deodorizing device 30 may include a deodorizing filter 32. The deodorizing filter 32 may be provided inside the second duct 16. Additionally, the deodorizing filter 32 may be positioned on a path through which cold air flows in the second duct 16.

The deodorizing filter 32 may contain a deodorizing agent capable of trapping or removing odor factors. Additionally, the deodorizing filter 32 may be composed of multiple layers containing various deodorizing agents overlapping one another.

The deodorizing filter 32 may be configured to divide at least a portion of the inside of the second duct 16. Accordingly, the air flowing through the second duct 16 can be deodorized while passing through the deodorizing filter 32.

The deodorizing device 30 may include a sterilization LED 161. The sterilization LED 161 may be fixed to one side of the second duct 16 and may irradiate light toward the deodorizing filter 32. For example, the sterilization LED 161 may be an LED that irradiates ultraviolet rays, and may sterilize bacteria in the deodorizing filter 32. In addition, the sterilization LED 161 can activate the catalyst of the deodorization filter 32 to enable deodorization and sterilization more smoothly.

The sterilization LED 161 is provided in the second duct 16, and when the deodorizing device 30 is separated, the sterilization LED may be in a state of being mounted in the second duct 16 separately from the deodorizing filter 32 and the deodorizing device cover 33. Therefore, there is an advantage in that the sterilization LED is easy to dispose and service wires.

The deodorizing device 30 may include a filter mounting part 31. The filter mounting part 31 is for fixing the deodorizing filter 32 and can be coupled to the second duct 16 or the deodorizing device cover 33. Accordingly, the filter mounting part 31 may be configured as a separate structure and coupled to the second duct 16 or the deodorizing device cover 33. Additionally, the filter mounting part 31 may be formed integrally with the second duct 16 or the deodorizing device cover 33.

The deodorizing filter 32 may be disposed at an angle based on the upper surface of the refrigerating chamber 11 by the filter mounting part 31. Additionally, the deodorizing filter may be disposed at an angle so as to cross the direction of air flow through the second duct 16. Accordingly, the air flowing along the second duct 16 can easily pass through the deodorizing filter 32. In addition, the filter mounting part 31 can maintain a gap between the deodorizing filter 32 and the deodorizing device cover 33.

Accordingly, it is possible to secure a flow space in which the air that has passed through the deodorizing filter 32 can be smoothly discharged through the deodorizing cover 172. One surface of the deodorizing filter 32 and the deodorizing device cover 33 may be disposed to have different inclinations by the filter mounting part 31.

The deodorizing filter 32 may be positioned between the second duct 16 and the upper discharge port 122. Accordingly, the air deodorized by the deodorizing filter 32 may be supplied to the refrigerating chamber 11 through the upper discharge port 122.

The deodorizing device 30 may include a deodorizing device cover 33. The deodorizing device cover 33 may be mounted on the end portion of the second duct 16. In addition, the deodorizing device cover may protrude from the inner case 102 forming the upper surface of the refrigerating chamber 11.

The deodorizing device cover 33 may be disposed between the upper discharge ports 122. The upper discharge port 122 may be disposed on both left and right sides of the deodorizing device cover 33. Additionally, the deodorizing device cover 33 may be disposed so that at least a portion of the deodorizing device cover overlaps the upper discharge port 122. Additionally, the deodorizing device 30 may partially communicate with the upper discharge port 122.

The deodorizing device cover 33 is provided below the deodorizing filter 32 and can shield the deodorizing filter 32. The deodorizing device cover 33 may further shield the end portion of the second duct 16.

The deodorizing device cover 33 may include a first surface 331 and a second surface 332 that are exposed when mounted on the upper surface of the refrigerating chamber 11. The first surface 331 may extend rearward from the front end of the deodorizing device cover 33. The first surface 331 may be in contact with the rear end of the lighting device 17. The first surface 331 shields the deodorizing filter 32 from below and may extend rearward to pass through the area of the deodorizing filter 32. Additionally, the first surface 331 may be formed to become lower as it extends rearward, forming the third inclined surface 331.

The third inclined surface 331 is disposed to be inclined in the same direction as the first inclined surface 121, but may have a greater inclination than the first inclined surface 121. In addition, the first surface 331 may be formed to be inclined in a direction that crosses the second inclined surface 173 of the lighting device 17. Accordingly, the light emitted from the LED 171 of the lighting device 17 may be irradiated onto the first surface 331 of the deodorizing device cover 33. Accordingly, the first surface 331 can be highlighted by the lighting device 17, and thus the deodorizing function can be emphasized to the user.

The extended rear end of the first surface 331 may be the lowest part of the deodorizing device 30. Additionally, the rear end of the first surface 331 may be the position that protrudes most from the upper surface of the refrigerating chamber 11. At this time, the extended rear end of the first surface 331, that is, the lower end of the deodorizing device 30, may be positioned higher than the lower end of the first inclined surface 121 and the lower end of the second inclined surface 173. Accordingly, it is possible to prevent excessive exposure or protrusion of the deodorizing device 30 when viewed from the front by the user.

The second surface 332 may be bent at the rear end of the first surface 331. The second surface 332 may extend in a direction crossing the first surface 331. The second surface 332 extends rearward from the rear end of the first surface 331 and may extend upward. In other words, the second surface 332 may have an upward slope as the second surface extends rearward. In addition, the rear end of the second surface 332 may be in contact with the inner case 102.

A deodorizing discharge port 333 may be formed on the second surface 332. The deodorizing discharge port 333 passes through the second surface 332 and may be opened to face rearward. Accordingly, the air passing through the deodorizing filter 32 may be discharged toward the inside of the refrigerating chamber 11. In addition, the opening direction of the deodorizing discharge port 333 may cross the opening direction of the upper discharge port 122. Accordingly, cold air discharged through the second duct 16 may be simultaneously discharged in one direction through the upper discharge port 122 and in another direction through the deodorizing discharge port 333. At this time, the discharge direction of the deodorizing discharge port 333 may be toward the center of the refrigerating chamber 11.

In addition, the deodorizing device cover 33 can be separated from the deodorizing filter 32 by a sufficient distance due to the inclined structure of the first surface 331 and the second surface 332, and a flow space can be secured so that the air that has passed through the deodorizing filter 32 can be smoothly discharged toward the center of the refrigerating chamber 11.

Meanwhile, the cold air generated for the evaporator 13 flows along the first duct 15 and the second duct 16 by driving the blowing fan 14, passes through the deodorizing device 30, and may be discharged into the refrigerating chamber 11. Therefore, it is possible to supply deodorized air to the refrigerating chamber 11 without a separate fan for deodorization. In other words, since a flow structure for deodorization can exist on the cold air supply system in the refrigerator, there is an advantage of reducing unnecessary configuration and reducing power consumption.

In addition, the odor factor in the air, which is primarily deodorized by removing in the very low-temperature evaporator 13, does not spread because the odor factor flows through the insulated first duct 15 and second duct 16, and the odor factor in the air when the temperature is still low may be discharged in a finally deodorized state from the deodorizing device 30 disposed at the end of the cold air flow path.

Accordingly, when the refrigerating chamber door 21 is opened, the user positioned in the front surface of the refrigerating chamber 11 is exposed to a cold air environment in a deodorized state, and thus discomfort caused by odor can be prevented.

Additionally, cold air deodorized and discharged from the front end of the upper surface of the refrigerating chamber 11 may be suctioned into the lower end of the rear surface of the refrigerating chamber 11 and flow into the evaporator 13. Therefore, the path on the upper discharge port 122 and the suction port 112, which are diagonally separated from each other, can be a path crossing the refrigerating chamber 11, and the cooling efficiency and deodorizing efficiency of the refrigerating chamber 11 can be maximized.

Meanwhile, the present disclosure may have various other embodiments in addition to the above-described embodiments. Hereinafter, another embodiment of the present disclosure will be described in detail with reference to the drawings. In addition, since configurations not described below are the same as the above-described embodiments, detailed descriptions and illustrations thereof are omitted to prevent duplication of description, and the configurations not described below are described using the same reference numerals. In other words, hereinafter, only the configuration that differs from the above-described embodiment will be described in detail.

Figure 5:
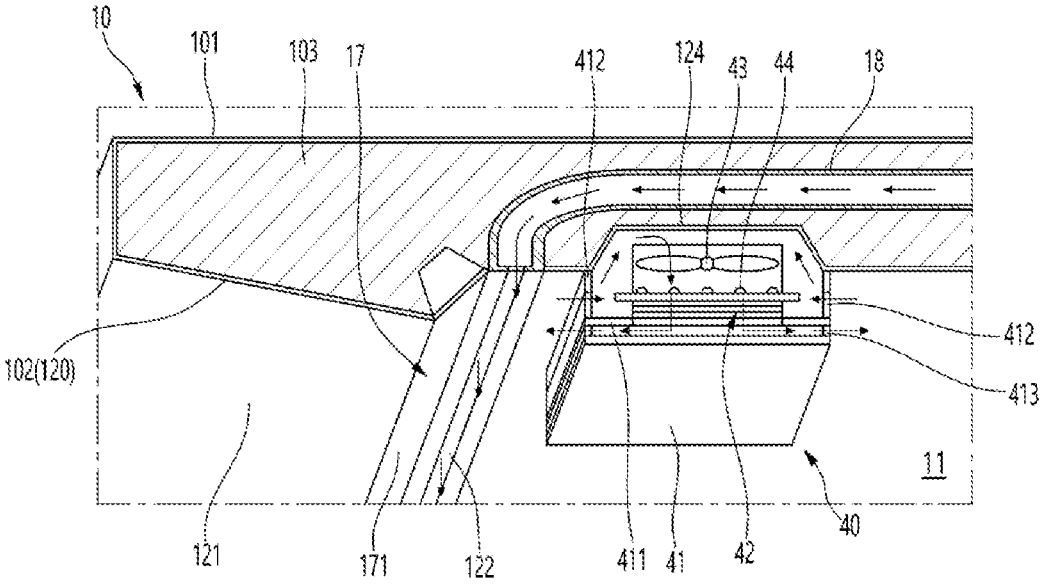
FIG. 5 is a cut-away perspective view illustrating the disposition structure and the cold air flow of the deodorizing device according to the second embodiment of the present disclosure.

FIG. 5 is a cut-away perspective view illustrating the disposition structure and the cold air flow of the deodorizing device according to the second embodiment of the present disclosure.

As illustrated, the cabinet 10 of the refrigerator 1 according to the second embodiment of the present disclosure is composed of an outer case 101 and an inner case 102, and the inside thereof may be filled with insulating material 103.

In addition, a lighting device 17 may be provided on the upper surface 120 of the refrigerating chamber 11, and the upper discharge port 122 may be positioned at the rear end of the lighting device 17. Additionally, the second duct 18 may be disposed between the outer case 101 and the inner case 102. The second duct 18 may be embedded in the insulating material 103.

Additionally, the deodorizing device 40 may be provided behind the upper discharge port 122. The deodorizing device 40 may be disposed adjacent to the front end of the upper surface 120 of the refrigerating chamber 11. Additionally, the deodorizing device 40 may be placed adjacent to the upper discharge port 122.

The deodorizing device 40 may be mounted on the inner case 102 forming the upper surface 120 of the refrigerating chamber 11. In addition, the inner case 102 may be formed with a recessed part 124 to accommodate at least a portion of the deodorizing device 40.

Accordingly, at least a portion of the deodorizing device 40 may be disposed upward with respect to the upper surface of the refrigerating chamber 11. The deodorizing device 40 may be positioned below the second duct 18. Accordingly, the deodorizing device 40 can be inserted into the space formed between the second duct 18 and the inner case 102.

In addition, at least a portion of the deodorizing device 40 may protrude downward from the upper surface of the refrigerating chamber 11. At this time, the protruding lower end of the deodorizing device 40 may be positioned higher than the lower ends of the first inclined surface 121 and the second inclined surface 173. Accordingly, when viewed from the front, at least a portion of the deodorizing device 40 may be covered by the first inclined surface 121 or the second inclined surface 173.

The deodorizing device 40 may be disposed in the front half of the refrigerating chamber 11 adjacent to the lighting device 17. Therefore, the light irradiated through the second surface 332 of the lighting device 17 can illuminate a portion of the deodorizing device 40, and when viewed by the user, the portion of the deodorizing device 40 may be emphasized.

The deodorizing device 40 may include a deodorizing fan 43, a deodorizing filter 42, and a deodorizing device cover 41.

The deodorizing device cover 41 may be mounted on the inner case 102 and form the outer appearance of the deodorizing device 40. In addition, the deodorizing device cover 41 may shield the deodorizing fan 43 and the deodorizing filter 42.

The lower surface of the deodorizing device cover 41 may be formed in a planar shape parallel to the upper surface of the refrigerating chamber 11. The lower surface of the deodorizing device cover 41 may be positioned higher than the lower end of the first inclined surface 121 or the second inclined surface 173.

A deodorizing device suction port 412 and a deodorizing device discharge port 413 may be formed on the circumferential surface of the deodorizing device cover 41. The deodorizing device suction port 412 and the deodorizing device discharge port 413 may be formed along the circumferential surface of the deodorizing device cover 41. A plurality of the deodorizing device suction port 412 and the deodorizing device discharge port 413 may be formed along the deodorizing device cover 41.

For example, the deodorizing device suction port 412 may be positioned higher than the deodorizing device discharge port 413. In addition, at least some of the deodorizing device suction port 412 may be disposed adjacent to the upper discharge port 122. Therefore, the cold air discharged from the upper discharge port 122 can immediately flow into the deodorizing device suction port 412 and be deodorized.

A deodorizing filter mounting part 411 may be formed on the deodorizing device cover 41. The deodorizing filter mounting part 411 may be disposed between the deodorizing device suction port 412 and the deodorizing device discharge port 413 and may allow the deodorizing filter 42 to be fixedly mounted.

Additionally, the deodorizing fan 43 may be provided above the deodorizing filter 42. The deodorizing fan 43 may be configured as a box fan structure. Therefore, when the deodorizing fan 43 is driven, the air suctioned into the deodorizing device suction port 412 may pass through the deodorizing filter 42, the air passing through the deodorizing filter 42 pass through the deodorizing device discharge port 413, and be discharged into the refrigerating chamber 11.

In addition, the deodorizing device 40 may further include a sterilization LED 44. The sterilization LED 44 may be provided between the deodorizing fan 43 and the deodorizing filter 42, and may irradiate light toward the deodorizing filter 42. The deodorizing performance of the deodorizing filter 42 is activated by the sterilization LED 44 and thus sterilization becomes possible. The structure of the deodorizing filter 42 and the sterilization LED 44 may be the same as the above-described embodiment.

Meanwhile, the cold air generated in the evaporator 13 may flow along the first duct 15 and the second duct 18 by driving the blowing fan 14, flow through the upper discharge port 122, and be discharged into the refrigerating chamber 11.

Additionally, the cold air discharged from the upper discharge port 122 may flow into the adjacent deodorizing device 40, be deodorized, and then be discharged back into the refrigerating chamber 11. At this time, the upper discharge port 122 and the deodorizing device suction port 412 are so close that the cold air discharged from the second duct 18 can substantially directly pass through the deodorizing device 40. The upper discharge port 122 and the deodorizing device suction port 412 may have a structure that communicates with each other.

Therefore, the odor factor in the air that is primarily deodorized by being removed in the evaporator 13, which has a very low temperature, does not spread because the odor factor flows through the insulated first duct 15 and the second duct 18, and the odor factor in the air, which is still at a low temperature, may be discharged in a finally deodorized state from the deodorizing device 40 disposed at the end of the cold air flow path.

Accordingly, when the refrigerating chamber door 21 is opened, the user positioned in the front surface of the refrigerating chamber 11 is exposed to a cold air environment in a deodorized state, and thus discomfort caused by odor can be prevented.

In addition, the cold air deodorized and discharged through the deodorizing device 40 at the front end of the upper surface of the refrigerating chamber 11 may be suctioned into the suction port 112 at the lower end of the rear surface of the refrigerating chamber 11 and flow into the evaporator 13 to be circulated.

What is claimed is:

1. A refrigerator comprising:

a cabinet that defines a storage space having an open front surface;

a door disposed at the cabinet and configured to open and close at least a portion of the storage space;

an evaporator disposed at the cabinet;

an upper duct that extends along an upper surface of the storage space and is configured to guide cold air from the evaporator in a front-rear direction, the upper duct having an upper discharge port that is defined at a front end of the upper surface of the storage space and configured to discharge the cold air; and a deodorizing device disposed at the upper surface of the storage space, wherein the deodorizing device is disposed adjacent to the upper discharge port and configured to deodorize the cold air discharged through the upper discharge port, wherein the cabinet comprises:

an outer case that defines an outer appearance of the cabinet, an inner case that is spaced apart from the outer case and defines the storage space, a first insulating material provided between the outer case and the inner case, and a second insulating material provided between the upper duct and the upper surface of the storage space, wherein the upper duct is disposed between the outer case and the inner case and surrounded by the first insulating material, and wherein an insulation coefficient of the second insulating material is greater than an insulation coefficient of the first insulating material.

2. The refrigerator of claim 1, wherein the deodorizing device is configured to receive a deodorizing filter, the deodorizing filter being configured to interfere with the cold air passing through the upper duct, wherein the deodorizing device further comprises:

a deodorizing filter mounting part configured to support the deodorizing filter; and a deodorizing cover that covers the deodorizing filter and defines an exterior surface of the deodorizing device, the deodorizing cover defining a deodorizing device discharge port configured to discharge air that is deodorized through the deodorizing filter.

3. The refrigerator of claim 2, wherein the deodorizing device further comprises a sterilization light emitting diode (LED) configured to irradiate light for sterilization toward the deodorization filter.

4. The refrigerator of claim 2, wherein the upper duct defines the deodorizing filter mounting part, the upper duct being configured to receive the deodorizing filter therein.

5. The refrigerator of claim 2, wherein the deodorizing cover defines the deodorizing filter mounting part, the deodorizing cover being configured to receive the deodorizing filter thereon.

6. The refrigerator of claim 2, wherein the upper discharge port is defined at left and right sides with respect to the deodorizing cover.

7. The refrigerator of claim 2, wherein the deodorizing cover comprises:

a first surface that is inclined with respect to the upper surface of the storage space, the first surface extending away from a lower surface of the deodorizing filter as the first surface extends rearward; and a second surface that is connected to a rear end of the first surface and inclined with respect to the first surface, the second surface defining the deodorizing device discharge port.

8. The refrigerator of claim 7, wherein the first surface of the deodorizing cover extends rearward relative to a rear end of the deodorizing filter.

9. The refrigerator of claim 2, wherein the deodorizing device further comprises a deodorizing fan configured to force air flow to pass through the deodorizing filter, wherein the cabinet defines a recessed part at the upper surface of the storage space, the recessed part accommodating at least a portion of the deodorizing device and being covered by the deodorizing cover, and wherein the deodorizing device is disposed rearward relative to the upper discharge port.

10. The refrigerator of claim 9, wherein the deodorizing cover comprises a circumferential surface that protrudes downward relative to the recessed part and defines the deodorizing device discharge port, and wherein the circumferential surface of the deodorizing cover further defines a deodorizing device suction port configured to introduce the cold air discharged from the upper discharge port into the deodorizing device.

11. The refrigerator of claim 10, wherein the deodorizing device suction port is disposed above the deodorizing device discharge port.

12. The refrigerator of claim 1, further comprising:

a rear duct that is disposed at a rear surface of the storage space and extends vertically, the rear duct being configured to guide the cold air from the evaporator upward, wherein the rear duct defines a rear discharge port configured to discharge the cold air forward, and wherein an upper end of the rear duct is connected to a rear end of the upper duct.

13. The refrigerator of claim 1, wherein the cabinet defines a suction port at a lower end of a rear surface of the storage space, the suction port being configured to introduce cold air from the storage space toward the evaporator, and wherein the deodorizing device defines a deodorizing device discharge port at a position spaced apart from the suction port in a diagonal direction of the storage space.

14. A refrigerator comprising:

a cabinet that defines a storage space having an open front surface;

a door disposed at the cabinet and configured to open and close at least a portion of the storage space;

an evaporator disposed at the cabinet;

an upper duct that extends along an upper surface of the storage space and is configured to guide cold air from the evaporator in a front-rear direction, the upper duct having an upper discharge port that is defined at a front end of the upper surface of the storage space and configured to discharge the cold air; and a deodorizing device disposed at the upper surface of the storage space, wherein the deodorizing device is disposed adjacent to the upper discharge port and configured to deodorize the cold air discharged through the upper discharge port, wherein the cabinet defines a first inclined surface at the front end of the upper surface of the storage space, the first inclined surface being configured to face a circumference of the door based on the door being closed, and wherein the first inclined surface protrudes downward as the first inclined surface extends rearward.

15. The refrigerator of claim 14, wherein the deodorizing device is positioned rearward relative the first inclined surface, and wherein at least a portion of the deodorizing device is disposed above a lower end of the first inclined surface.

16. The refrigerator of claim 14, further comprising a lighting device disposed at the upper surface of the storage space, the lighting device being disposed between the first inclined surface and the deodorizing device.

17. The refrigerator of claim 16, wherein the lighting device comprises:

a light emitting diode (LED); and a light cover that covers the LED and is exposed to the storage space, the light cover being configured to transmit light emitted from the LED, and wherein the light cover defines a second inclined surface inclined with respect to the first inclined surface.

18. The refrigerator of claim 17, wherein the deodorizing device comprises a deodorizing cover that defines a deodorizing device discharge port configured to discharge deodorized air, wherein the deodorizing cover has an outer surface that defines a third inclined surface inclined with respect to the second inclined surface, the third inclined surface being inclined downward as the third inclined surface extends rearward, and wherein the third inclined surface extends in a direction crossing the second inclined surface and is configured to face the light emitted from the lighting device.

* * * * *